US008341997B2

(12) United States Patent
Matsui

(10) Patent No.: US 8,341,997 B2
(45) Date of Patent: Jan. 1, 2013

(54) METHOD OF FORGING BEVEL GEAR

(75) Inventor: Yasuyoshi Matsui, Kosai (JP)

(73) Assignee: Musashi Seimitsu Industry Co., Ltd., Toyohashi (JP)

( * ) Notice: Subject to any disclaimer, the term of this patent is extended or adjusted under 35 U.S.C. 154(b) by 799 days.

(21) Appl. No.: 12/453,824

(22) Filed: May 22, 2009

(65) Prior Publication Data

US 2009/0293573 A1 Dec. 3, 2009

(30) Foreign Application Priority Data

May 30, 2008 (JP) ..... 2008-143209

(51) Int. Cl.
*B21J 13/00* (2006.01)

(52) U.S. Cl. ..... 72/354.6; 72/352; 72/358

(58) Field of Classification Search ..... 72/352, 72/354.6, 355.2, 355.4, 355.6, 358, 359
See application file for complete search history.

(56) References Cited

U.S. PATENT DOCUMENTS

| | | | | |
|---|---|---|---|---|
| 6,250,128 | B1 * | 6/2001 | Ando et al. | 72/355.6 |
| 6,349,582 | B2 * | 2/2002 | Tanaka et al. | 72/30.1 |
| 7,677,073 | B2 * | 3/2010 | Tanabe | 72/352 |
| 7,690,236 | B2 * | 4/2010 | Otaki | 72/355.6 |

FOREIGN PATENT DOCUMENTS

| | | |
|---|---|---|
| JP | 56-163048 | * 12/1981 |
| JP | 64-2756 | * 1/1989 |
| JP | A-2004-58120 | 2/2004 |
| JP | 2005-7480 | * 1/2005 |
| JP | B2-3690780 | 6/2005 |
| JP | 2006-305600 | * 11/2006 |

* cited by examiner

*Primary Examiner* — Edward Tolan
(74) *Attorney, Agent, or Firm* — Oliff & Berridge, PLC

(57) ABSTRACT

The present invention is a method of forging a bevel gear, comprising: a first forging step in which a first intermediate article is obtained by pressing a blank, such that there is formed a preliminary one-end recessed part that is axially recessed in an axis-center part on an axially one-end side and/or a preliminary other-end recessed part that is axially recessed in an axis-center part on an axially other-end side; a second forging step in which a second intermediate article is obtained by pressing the first intermediate article in a hermetically sealed cavity space defined by a first die and a second die that is positioned opposedly to the first die in the axial direction, such that there are formed: a body part including a tooth part on a radially circumference thereof and a one-end recessed part that is axially recessed in an axis-center part on the axially one-end side; and a projecting part projecting from a rear surface part of the body part on the axially other-end side; and a through-hole forming step in which a bevel gear having a through hole in an axis-center part is formed by removing the axis-center part extending from a bottom surface of the one-end recessed part to the projecting part of the second intermediate article. The tooth part provides a tooth-crest surface which is tapered from the axially other-end side to the axially one-end side, and upon completion of the second intermediate article in the second forging step, there remains an unfilled space between the projecting part of the second intermediate article and a wall surface of the dies defining the cavity space.

10 Claims, 9 Drawing Sheets

METHOD OF FORGING BEVEL GEAR

FIELD OF THE INVENTION

The present invention relates to a method of forging a bevel gear.

BACKGROUND ART

There has been conventionally known a method of forging a bevel gear, as shown in FIGS. 6A to 6D (see JP2004-58120A).

In this method, as shown in FIG. 6A, a cylindrical blank W100 is firstly prepared. When the cylindrical blank W100 is pressed in a cavity space of a die, as shown in FIG. 6, there are formed: a preliminary first body part 103*a* on an axially one-end side, the preliminary first body part 103*a* having a preliminary one-end recessed part 102 that is axially recessed in an axis-center part; and a preliminary second body part 103*b* on an axially other-end side, the preliminary second body part 103*b* projecting continuously from the axially other-end side of the preliminary first body part 103*a*, and the preliminary second body part 103*b* having a diameter smaller than that of the preliminary first body part 103*a*. Thus, a first intermediate article W101 is formed (first forging step).

When the first intermediate article W101 is pressed in a cavity space of another die, which is different from the die used in the first forging step, as shown in FIG. 6C, there are formed: a first body part 110*a* on the axially one-end side, the first body part 110*a* having a tooth part 109 on a radially outer circumference thereof; a second body part 110*b* on an axially intermediate portion, the second body part 110*b* projecting continuously from the axially other-end side of the first body part 110*a*, and having a diameter smaller than that of the first body part 110*a*; and a projecting part 115 on the axially other-end side, the projecting part 115 projecting continuously from a rear surface part 113 on the axially other-end side of the second body part 110*b*, and having a diameter smaller than that of the second body part 110*b*. At the same time, there is formed a one-end recessed part 107 that is axially recessed in the axis-center part on the axially one-end side of a body part 110 which is composed of the first body part 110*a* and the second body part 110*b*. Thus, a second intermediate article W102 is formed (second forging step). The tooth part 109 has a plurality of tooth crests 109*a* that define a tooth-crest surface which is tapered from the axially other-end side toward the axially one-end side. In addition, the second body part 110*b* is provided with a spline on an outer circumference thereof.

In the second forging step of this method, in order to promote plastic deformation (flow) of the blank, in a region corresponding to an outer circumference of the first body part 110*a* of the second intermediate article W102, the die has a portion whose dimensions are larger than the dimensions of the outer circumference of the first body part 110*a*. Namely, as a flow way for the blank, there is formed a superfluous space between the die and the outer circumference of the first body part 110*a* of the second intermediate article W102. This is based on the following view. That is, by positively promoting a partial flow of the blank, it is intended to promote the entire deformation of the blank into the second intermediate article W102.

However, because of the provision of this superfluous space, when the second intermediate article W102 is completed, there is formed, in addition to the tooth part 109, an unnecessary burr part 114 that radially projects outward from the outer circumference of the first body part 110*a* of the second intermediate article W102.

After the second forging step, as shown in FIG. 6D, an axis-center part 116 extending from a bottom surface of the one-side recessed part 107 to the projecting part 113 of the second intermediate article W102 is pierced and removed. However, formed by this piercing process is a bevel gear W103 which has a through hole 117 formed in the axis-center part and also still has the burr part 114. Namely, there is required a step in which the burr part 114 is removed.

In addition, since the outer circumferential surface of the preliminary first body part 103*a* of the first intermediate article W101, which is to be deformed into the tooth part 109, is in parallel with the axis line, a flow amount of the blank that is deformed into the tooth part 109 in the second forging step may be too much, resulting in undesired wrinkles (grooves) in the formed tooth crests 109*a*.

In addition, there has been conventionally known another method of forging a bevel gear, as shown in FIGS. 7A to 7D (see, JP Patent Publication No. 3690780).

Also in this method, as shown in FIG. 7A, a cylindrical blank W200 is firstly prepared. When the cylindrical blank W200 is pressed in a cavity (diemilled) space of a die, as shown in FIG. 7B, there are formed: a preliminary first body part 203*a* on an axially one-end side, the preliminary first body part 203*a* including a tapered part 204 whose diameter is increased from the axially one-end side toward an axially other-end side; and a preliminary second body part 203*b* on the axially other-end side, the preliminary second body part 203*b* projecting continuously from the axially other-end side of the preliminary first body part 203*a*, and having a diameter smaller than that of the preliminary first body part 203*a*. At the same time, there is formed a preliminary other-end recessed part 206 that is axially recessed in an axis-center part on the axially other-end side of the preliminary second body part 203*b*. Thus, a first intermediate article W201 is formed (first forging step).

When the first intermediate article W201 is pressed in a cavity space of another die that is different from the die used in the first forging step, as show in FIG. 7C, there are formed; a first body part 210*a* on the axially one-end side, the first body part 210*a* having a tooth part 209 on a radially outer circumference thereof; and a second body part 210*a* on the axially other-end side, the second body part 210*a* projecting continuously from the axially other-end side of the first body part 210*a*, and having a diameter smaller than that of the first body part 210*a*. At the same time, there is formed an other-end recessed part 214 that is axially recessed in the axis-center part on the axially other-end side of a body part 210 which is composed of the first body part 210*a* and the second body part 210*b*. Thus, a second intermediate article W202 is formed (second forging step). The tooth part 209 has a plurality of tooth crests 209*a* that define a tooth-crest surface which is tapered from the axially other-end side to the axially one-end side.

In the second forging step of this method, in order to prevent generation of underfills in the tooth part 209, when the second intermediate article W202 is completed in the second forging step, the hermetically sealed cavity space, which is defined in the die, is designed to be completely filled with the second intermediate article W202, that is, the overall outer surface of the second intermediate article W202 is brought into contact with the surface of the die defining the cavity space. This is based on the following view. Namely, in order to prevent generation of underfills, a high pressure applied by the cavity space is transmitted to the entire blank as if to envelope the same, while the blank is deformed into the second intermediate article W202.

After the second forging step of this method, as shown in FIG. 7D, an axis-center part 216 extending from the one end of the second intermediate article W202 to a bottom surface of the other-end recessed part 214 is pierced. Then, there is obtained a bevel gear W203 which has a through hole 217 formed in the axis-center part. In this method, a step of removing a burr part is unnecessary. The bevel gear W203 can be generally used as a bevel gear for a side gear for a differential gear.

However, in this method, when the second intermediate article W202 is completed, in the hermetically sealed cavity space, since the overall outer surface of the second intermediate article W202 is brought into contact with the surface of the die defining the cavity space (i.e., since there is no "clearance" therebetween), a large stress may be applied to the die. Thus, there is a problem in that a life time of the die is short (the die tends to be broken within a shorter period of time).

In addition, there is described a forging method on page 292 in "Plastic Process Guide" issued by Corona Publishing Co., Ltd. In this method, as shown in FIG. 8A, a cylindrical blank W300 is prepared. Then, by pressing the cylindrical blank W300 in a cavity space of a predetermined die, there is formed a first intermediate article W301 having a cross-sectional shape as shown in FIG. 8B. Then, by using another die, as shown in FIG. 8C, there is formed a second intermediate article W302 having a tooth part 309 on a radially outer circumference thereof. Thereafter, as shown in FIG. 8D, there is formed a third intermediate article W303 having a burr part 314 remaining on an outer circumference thereof. After that, an axis-center part is pierced, and the burr part 314 is removed. Thus, as shown in FIG. 8E, a bevel gear W305 having a through hole 317 is formed.

Similarly to the forging method that has been described with reference to FIGS. 6A to 6D, this forging method requires a step of removing the burr part 314.

There is also described another forging method on page 292 in the "Plastic Process Guide" issued by Corona Publishing Co., Ltd. In this method, as shown in FIG. 9A, a cylindrical blank W400 is prepared. Then, by pressing the cylindrical blank W400 in a cavity space of a predetermined die, there is formed a first intermediate article W401 having a cross-sectional shape as shown in FIG. 9B. Then, by using another die, as shown in FIG. 9C, a second intermediate article W403 having a tooth part 409 on a radially outer circumference thereof is formed in a hermetically sealed cavity space. Thereafter, an axis-center part is pierced. Thus, as show in FIG. 9D, a bevel gear W404 having a through hole 417 is formed.

Similarly to the forging method that has been described with reference to FIGS. 7A to 7D, this forging method has a problem in that, since a large stress is applied to the die for obtaining the second intermediate article W403, a life time of the die is short.

SUMMARY OF THE INVENTION

The present invention has been made in order to solve the above problems. The object of the present invention is to provide a forging method which can dispense with a step of removing a burr part, and can make longer a life time of a die.

A first invention is a method of forging a bevel gear, comprising: a first forging step in which a first intermediate article is obtained by pressing a blank, such that there is formed a preliminary one-end recessed part that is axially recessed in an axis-center part on an axially one-end side and/or a preliminary other-end recessed part that is axially recessed in an axis-center part on an axially other-end side; a second forging step in which a second intermediate article is obtained by pressing the first intermediate article in a hermetically sealed cavity space defined by a first die and a second die that is positioned opposedly to the first die in the axial direction, such that there are formed: a body part including a tooth part on a radially circumference thereof and a one-end recessed part that is axially recessed in an axis-center part on the axially one-end side; and a projecting part projecting from a rear surface part of the body part on the axially other-end side; and a through-hole forming step in which a bevel gear having a through hole in an axis-center part is formed by removing the axis-center part extending from a bottom surface of the one-end recessed part to the projecting part of the second intermediate article; wherein: the tooth part provides a tooth-crest surface which is tapered from the axially other-end side to the axially one-end side; and upon completion of the second intermediate article in the second forging step, there remains an unfilled space between the projecting part of the second intermediate article and a wall surface of the dies defining the cavity space.

According to the first invention, upon completion of the second intermediate article in the second forging step, since there remains the unfilled space between the projecting part of the second intermediate article and the wall surface of the dies defining the cavity space, the flowing blank remains not restricted at the projecting part throughout the second forging step (the blank can deform (flow) with a relatively low resistance). The positive promotion of the flow of the blank at the projecting part results in a promotion of the flow of the blank as a whole. Thereby, the tooth part free of underfill can be obtained with a high yield. In particular, this effect can be significantly remarkably produced when the projecting part and the tooth part as specified by the present invention (with respect to their shapes, their relative positions, and so on) are formed. This was confirmed by the actual test for mass production.

Further, since the flowing blank has a part (the projecting part) that is not restricted throughout the second forging step, there is no possibility that a stress caused in the first die and/or the second die by the second forging step might become excessively large. Thus, the life time of the first die as well as the life time of the second die can be maintained for a longer period of time.

Furthermore, the first intermediate article has the preliminary one-end recessed part that is axially recessed in the axis-center part on the axially one-end side, and/or the preliminary other-end recessed part that is axially recessed in the axis-center part on the axially other-end side. Thus, as compared with a case in which the preliminary one-end recessed part and/or the preliminary other-end recessed part are not formed, an amount of the blank from the bottom surface of the one-end recessed part to the projecting part of the second intermediate article (an amount of the blank that is removed in the through-hole forming step) can be smaller. This means that a utilization efficiency of the blank is high.

In the first invention, preferably, upon completion of the second intermediate article in the second forging step, the overall outer surface of the second intermediate article, excluding a radially outermost circumferential part of the tooth-crest surface of the tooth part and the projecting part, is brought into contact with the wall surfaces of the dies defining the cavity space. In this case, there remains no burr part which should be removed, whereby the bevel gear having the accomplished tooth part can be formed with the lesser number of steps.

In the first invention, preferably the first intermediate article has a tapered part whose diameter is increased from the axially one-end side toward the axially other-end side, at an axial position corresponding to the tooth part of the second intermediate article. In this case, there can be effectively restrained that a flow amount of the blank to be formed into the tooth part is too much and that undesired wrinkles (grooves) are thereby formed in the formed tooth crests.

In addition, in the first invention, preferably, the projecting part of the second intermediate article has an outside diameter smaller than an inside diameter of the one-end recessed part of the second intermediate article. In this case, an amount of the blank to be removed is smaller, and therefore an excellent utilization efficiency of the blank can be provided.

A second invention is a method of forging a bevel gear, comprising: a first forging step in which a first intermediate article is obtained by pressing a blank, such that there is formed a preliminary one-end recessed part that is axially recessed in an axis-center part on an axially one-end side and/or a preliminary other-end recessed part that is axially recessed in an axis-center part on an axially other-end side; a second forging step in which a second intermediate article is obtained by pressing the first intermediate article in a hermetically sealed cavity space defined by a first die and a second die that is positioned opposedly to the first die in the axial direction, such that there are formed: a body part including a tooth part on a radially circumference thereof and a one-end recessed part that is axially recessed in an axis-center part on the axially one-end side; and a projecting part projecting from a rear surface part of the body part on the axially other-end side; and a through-hole forming step in which a bevel gear having a through hole in an axis-center part is formed by removing the axis-center part extending from a bottom surface of the one-end recessed part to the projecting part of the second intermediate article; wherein: the tooth part provides a tooth-crest surface which is tapered from the axially other-end side to the axially one-end side; and in a region corresponding to the projecting part, the cavity space has a part that is gradually narrowed in accordance with a distance from the rear surface part of the body part on the axially other-end side.

According to the second invention, in the second forging step, a part of the cavity space gives a larger resistance to the projecting part, as a projecting amount (length) of the projecting part is increased (a distance from the rear surface part of the body part on the axially other-end side to a distal end of the projecting part is increased). Thus, by positively utilizing this principle, a flow amount of the whole blank can be desirably controlled. When the resistance given by the cavity space to the projecting part is increased, the flow amount of the whole blank is decreased and the formation of the tooth part is promoted in accordance therewith. Thus, a highly precise tooth part without any underfill or wrinkle can be formed with a higher yield. In particular, this effect can be significantly remarkably produced when the projecting part and the tooth part as specified by the present invention (with respect to their shapes, their relative positions, and so on) are formed. This was confirmed by the actual test for mass production.

Further, the first intermediate article has the preliminary one-end recessed part that is axially recessed in the axis-center part on the axially one-end side, and/or the preliminary other-end recessed part that is axially recessed in the axis-center part on the axially other-end side. Thus, as compared with a case in which the preliminary one-end recessed part and/or the preliminary other-end recessed part are not formed, an amount of the blank from the bottom surface of the one-end recessed part to the projecting part of the second intermediate article (an amount of the blank that is removed in the through-hole forming step) can be smaller. This means that a utilization efficiency of the blank is high.

Also in the second invention, it is preferable that upon completion of the second intermediate article in the second forging step, there remains an unfilled space between the projecting part of the second intermediate article and a wall surface of the dies defining the cavity space. In this case, the flowing blank remains not restricted at the projecting part throughout the second forging step (the blank can deform (flow) with a relatively low resistance). Thus, there is no possibility that a stress in the first die and/or the second die by the second forging step might become excessively large. Thus, the life time of the first die as well as the life time of the second die can be maintained for a longer period of time.

In addition, also in the second invention, preferably, upon completion of the second intermediate article in the second forging step, the overall outer surface of the second intermediate article, excluding a radially outermost circumferential part of the tooth-crest surface of the tooth part and the projecting part, is brought into contact with the wall surfaces of the dies defining the cavity space. In this case, there remains no burr part which should be removed, whereby the bevel gear having the accomplished tooth part can be formed with the lesser number of steps.

In addition, also in the second invention, preferably, the first intermediate article has a tapered part whose diameter is increased from the axially one-end side toward the axially other-end side, at an axial position corresponding to the tooth part of the second intermediate article. In this case, there can be effectively restrained that a flow amount of the blank to be formed into the tooth part is too much and that undesired wrinkles (grooves) are thereby formed in the tooth crests of the formed tooth part.

In addition, also in the second invention, preferably, the projecting part of the second intermediate article has an outside diameter smaller than an inside diameter of the one-end recessed part of the second intermediate article. In this case, an amount of the blank to be removed is smaller, and therefore an excellent utilization efficiency of the blank can be provided.

A third invention is a forging apparatus for a bevel gear, comprising: a first die, and a second die that is positioned opposedly to the first die in an axial direction, wherein in a hermetically sealed cavity space defined by the first die and the second die, a first intermediate article including a preliminary one-end recessed part that is axially recessed in an axis-center part on an axially one-end side and/or a preliminary other-end recessed part that is axially recessed in an axis-center part on an axially other-end side is adapted to be forged into a second intermediate article, such that there are formed: a body part including a tooth part on a radially circumference thereof and a one-end recessed part that is axially recessed in an axis-center part on the axially one-end side; and a projecting part projecting from a rear surface part of the body part on the axially other-end side; the tooth part provides a tooth-crest surface which is tapered from the axially other-end side to the axially one-end side; and in a region corresponding to the projecting part, the cavity space has a part that is gradually narrowed in accordance with a distance from the rear surface part of the body part on the axially other-end side.

BEST MODE FOR CARRYING OUT THE INVENTION

Embodiments of the present invention will be described in detail below, with reference to the drawings.

Figure 2:
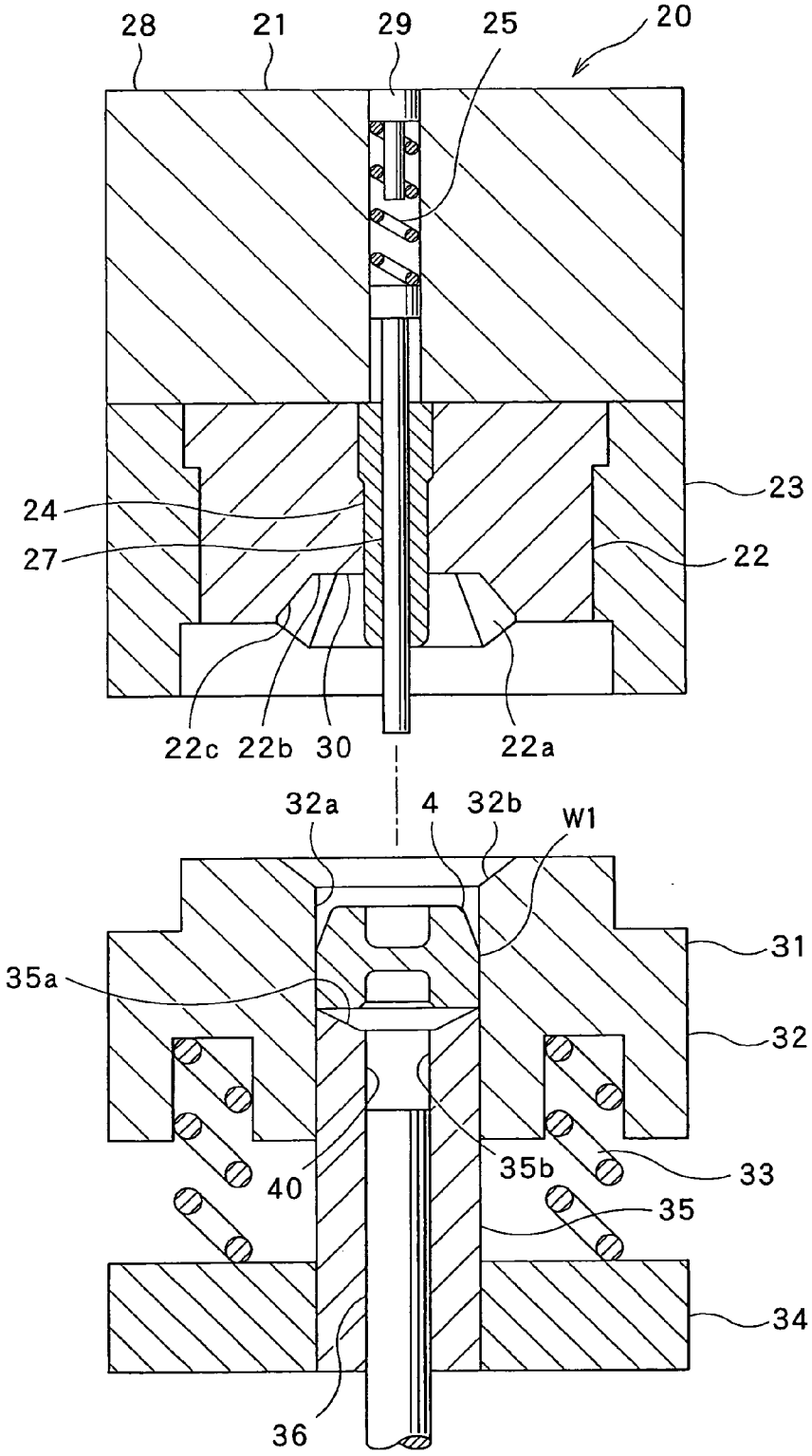
FIG. 2 is a partially sectional view showing a first die, a second die, and a first intermediate article, in a state before a second forging step of the first embodiment of the method of forging a bevel gear according to the present invention is performed.
Figure 3:
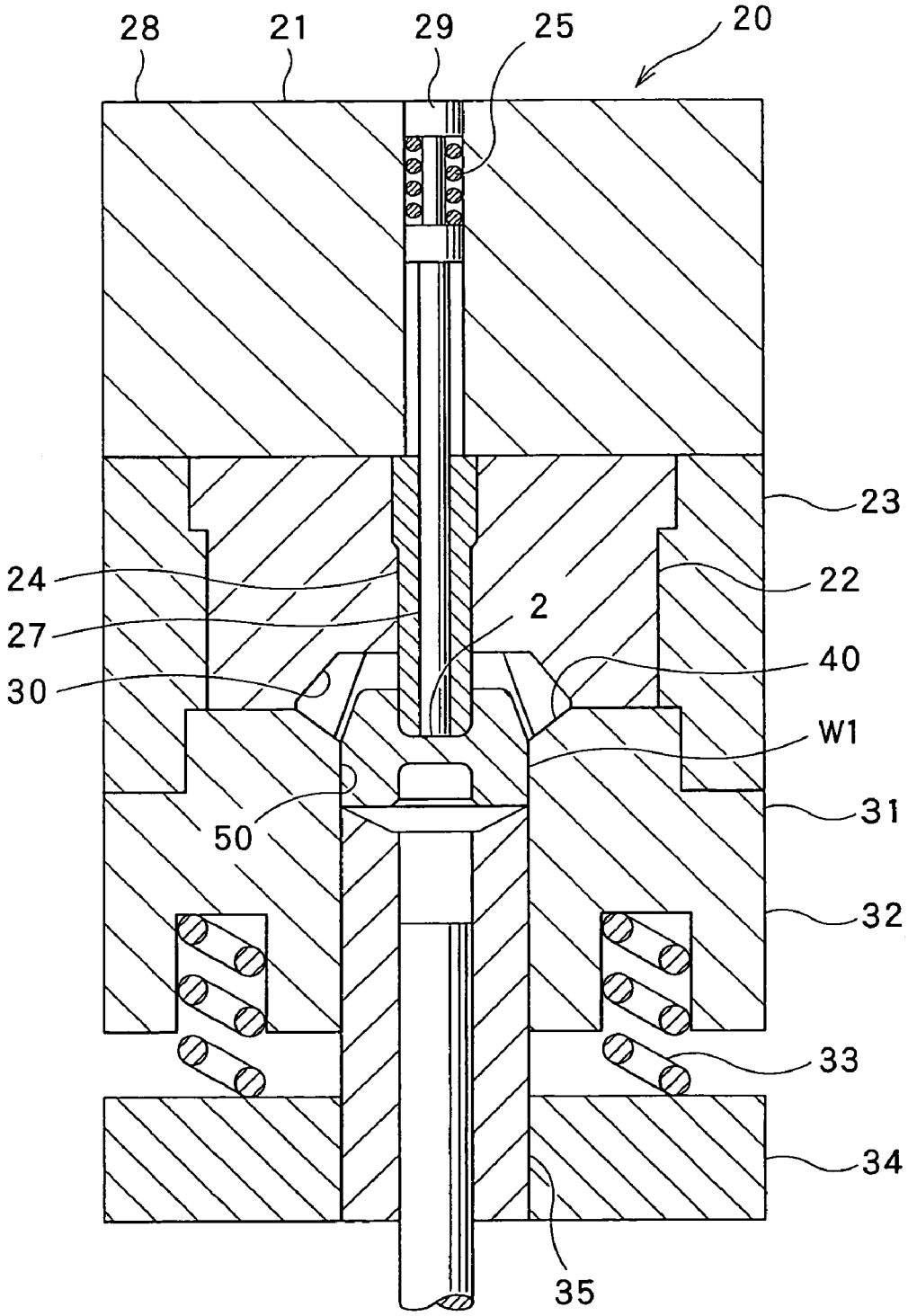
FIG. 3 is a partially sectional view showing the first die, the second die, and the first intermediate article, in a state immediately before the second forging step of the first embodiment of a method of forging a bevel gear according to the present invention is performed.
Figure 4:
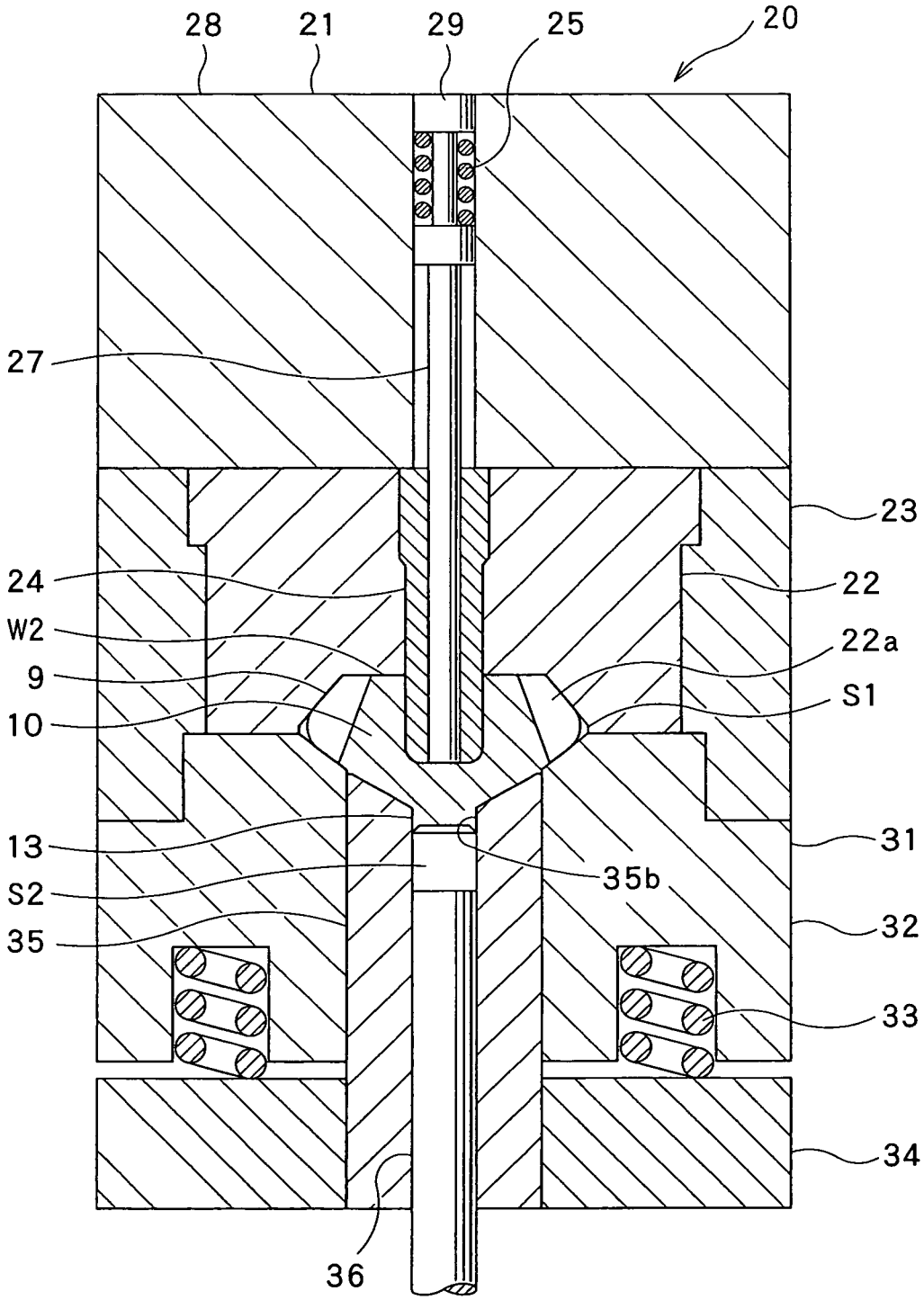
FIG. 4 is a partially sectional view showing the first die, the second die, and a second intermediate article, in a state after the second forging step of the first embodiment of a method of forging a bevel gear according to the present invention has been performed.

FIGS. 1A to 1D, which are shown for explaining respective steps of a first embodiment of a method of forging a bevel gear according to the present invention, are sectional views showing a blank (bevel gear) in the respective steps. FIG. 2 is a partially sectional view showing a first die, a second die, and a first intermediate article, in a state before a second forging step of the first embodiment of the method of forging a bevel gear according to the present invention is performed. FIG. 3 is a partially sectional view showing the first die, the second die, and the first intermediate article, in a state immediately before the second forging step of the first embodiment of a method of forging a bevel gear according to the present invention is performed. FIG. 4 is a partially sectional view showing the first die, the second die, and a second intermediate article, in a state after the second forging step of the first embodiment of a method of forging a bevel gear according to the present invention has been performed;

Based on FIGS. 1A to 1D, there is described the first embodiment of a method of forging a bevel gear according to the present invention.

Figure 1A:
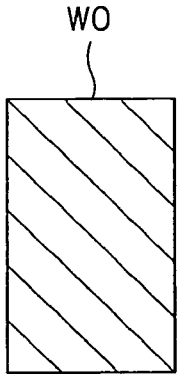
FIGS. 1A to 1D, which are shown for explaining respective steps of a first embodiment of a method of forging a bevel gear according to the present invention, are sectional views showing a blank (bevel gear) in the respective steps.

In this embodiment, as shown in FIG. 1A, a cylindrical blank W0 is firstly prepared. The cylindrical blank W0 can be obtained by cutting a wire rod into blanks of a required length, for example.

Figure 1B:
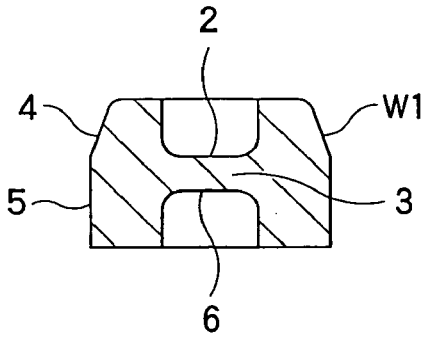

By axially pressing the cylindrical blank W0 in a cavity space of a die, there are formed: a preliminary one-end recessed part 2 that is axially recessed in an axis-center part on an axially one-end side; and a preliminary other-end recessed part 6 that is axially recessed in an axis-center part on an axially other-end side. At the same time, there are formed: a tapered part 4 which starts from an end on the axially one-end side and whose diameter is increased toward the axially other-end side; and a same-diameter part 5 which is continuous from the tapered part 4 and whose diameter is the same up to an end on the axially other-end side. Thus, as shown in FIG. 1B, a first intermediate article W1 is formed (first forging step). A part between the preliminary one-end recessed part 2 and the preliminary other-end recessed part 6 is a preliminary axis-center part 3.

Figure 1C:
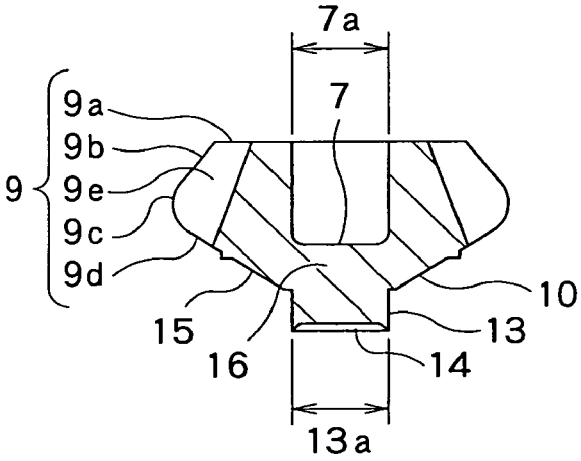

By axially pressing the first intermediate article W1 in a cavity space (described below) of another die, which is different from the die used in the first forging step, as shown in FIG. 1C, there is formed a body part 10 having a tooth part 9 on a radially outer circumference thereof and a one-end recessed part 7 that is axially recessed in the axis-center part on the axially one-end side. At the same time, there is formed a projecting part 13 projecting from a rear surface part 15 of the body part 10 on the axially other-end side. Thus, a second intermediate article W2 is formed (second forging step).

The tooth part 9 includes: an end surface 9*a* on the axially one-end side; a plurality of tooth crests 9*b* that define a tooth-crest surface which is tapered toward the end surface 9*a* from the axially other-end side; a plurality of outer circumferential parts 9*c* that are respectively continuous from the tooth crests 9*b*; a tooth-part other-end surface 9*d* on the axially other-end side; and a plurality of tooth roots 9*e* each of which connects adjacent two tooth crests 9*b*. The tooth part 9 is formed with a significantly high precision, and thus has an accomplished shape that does not require a succeeding sizing process and/or a succeeding cutting process.

The projecting part 13 is of a cylindrical shape, and an outside diameter 13*a* thereof is smaller than an inside diameter 7*a* of the one-end recessed part 7. A part extending from a bottom surface of the one-end recessed part 7 to the projecting part 13 provides an axis-center part 16.

As shown in FIG. 1C, there may be formed an other-end recessed part 14 that is axially recessed to an extent smaller than the preliminary other-end recessed part 6 of the first intermediate article W1. However, such an other-end recessed part 14 may not be formed.

Figure 1D:
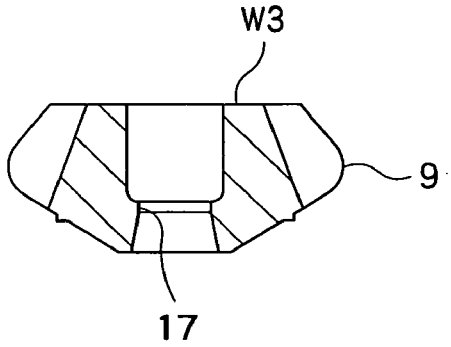

After the second forging step, the axis-center part 16 extending from the bottom surface of the one-end recessed part 7 to the projecting part 13 of the second intermediate article W2 is pierced by a forging apparatus, not shown (through-hole forming step). Thus, as shown in FIG. 1D, there is obtained a bevel gear W3 having a through hole 17 in the axis-center part. The bevel gear W3 is generally used as a bevel gear for a pinion gear for a differential gear.

In the above method of forging the bevel gear W3, the second forging step, in which the second intermediate article W2 is formed from the first intermediate article W1, is described in detail with reference to FIGS. 2 to 4. The second forging step is performed by a cold forging. As compared with a hot forging, the cold forging can provide a forging process with a higher precision.

As shown in FIG. 2, a forging apparatus 20 used in the second forging step includes a first die 21, and a second die 31 that is positioned opposedly to the first die 21 in the axial direction.

The first die 21 includes: a substantially cylindrical first center die 22 having a first tooth-part forming part 22*a*; a substantially cylindrical first-center-die holder 23 positioned on an outer circumferential side of the first center die 22 so as to hold the first center die 22; a substantially cylindrical pierce 24 positioned on an inner circumferential side of the first center die 22 and projecting toward the second die 31; a substantially columnar first knockout pin 27 positioned on an inner circumferential side of the pierce 24, the first knockout pin 27 being axially movable by a first elastic member 25; a cylindrical first base die 28 that holds (guides) the first knockout pin 27 such that the first knockout pin 27 can be vertically (axially) moved; and a substantially columnar rearward-movement restricting member 29 that restricts a range in which the first knockout pin 27 is rearwardly moved.

The first tooth-part forming part 22*a* of the first center die 22 has a tooth-part one-end-surface forming part 22*b*, which is perpendicular to the axial line, and a tooth-crest forming part 22*c* which corresponds to the plurality of tooth crests 9*b* that define the tooth-crest surface tapered toward the end surface 9*a* from the axially other-end side. A first cavity space 30 is defined by an inner surface of the first center die 22 including the first tooth-part forming part 22*a* and an outer circumferential surface of the pierce 24.

The second die 31 has: a cylindrical second base die 34 serving as a base part; a floating die 32 located apart from the second base die 34 by a second elastic member 33, the floating die 32 having a hole part 32*a* in a center thereof; a cylindrical second center die 35 positioned on an inner circumferential side of the floating die 32 and the second base die 34; and a columnar second knockout pin 36 positioned on an inner circumferential side of the second center die 35, the second knockout pin 36 being axially movable.

The floating die 32 has a tooth-part other-end-surface forming part 32*b* whose diameter is decreased from an end thereof on the axially one-end side toward the axially other-end side. The tooth-part other-end-surface forming part 32*b* constitutes a second tooth-part forming part for forming the tooth part 9 on the side of the second die 31.

The second center die 35 has a rear-surface-part forming part 35*a* whose diameter is decreased from an end thereof on the axially one-end side toward the axially other-end side. On the other-end side of the rear-surface-part forming part 35*a*, the second center die 35 has a projecting-part forming part 35*b* that is continuous from the rear-surface-part forming part 35*a*, the projecting-part forming part 35*b* having a diameter smaller than that of the rear-surface-part forming part 35*a*. A second cavity space 40, into which the first intermediate article W1 is to be set, is defined by the hole part 32*a* of the floating die 32, the rear-surface-part forming part 35*a* and the projecting-part forming part 35*b* of the second center die 35, and an upper surface of the second knockout pin 36.

With reference to FIGS. 2 to 4, there is described the second forging step, in which the second intermediate article W2 is formed from the first intermediate article W1 with the use of the aforementioned forging apparatus 20.

As shown in FIG. 2, when the second intermediate article W2 is formed from the first intermediate article W1, the first intermediate article W1 is set into the second cavity space 40 of the second die 31 such that the tapered part 4 faces the first die 21. Then, the first die 21 is moved toward the second die 31.

In the course of this movement, a distal end of the first knockout pin 27 is brought into contact with the preliminary one-end recessed part 2 of the first intermediate article W1 (the first knockout pin 27 and the preliminary one-end recessed part 2 are coaxially positioned, and the diameter of the first knockout pin 27 is smaller than that of the preliminary one-end recessed part 2). Then, during the further movement, the first elastic member 25 is contracted. Finally, as shown in FIG. 3, a rear end of the first knockout pin 27 is in contact with the rearward-movement restricting member 29. At this time, as shown in FIG. 3, a distal end of the pierce 24 is coplanar with the distal end of the first knockout pin 27. Namely, similarly to the distal end of the knockout pin 27, the distal end of the pierce 24 is brought into contact with the preliminary one-end recessed part 2 of the first intermediate article W1 (the diameter of the pierce 24 is slightly smaller than that of the preliminary one-end recessed part 2). In addition, at this time, the first die 21 and the floating die 32 of the second die 31 are fitted to each other. Thus, the first cavity space 20: and the second lower cavity space 40 are connected to each other, whereby a hermetically sealed and enclosed cavity space (50) is formed (defined).

Thereafter, the first die 21 and the floating die 32 of the second die 31, which are fitted to each other, are pressed onto the second base die 34 of the second die 31. Then, as shown in FIG. 4, the second elastic member 33 is contracted so that the first die 21 and the floating die 32 of the second die 31 are moved toward the second base die 34 of the second die 31. At this time, the pierce 24 and the first knockout pin 27 press the preliminary axis-center part 3 of the first intermediate article W1 toward the second center die 35. Thus, the blank (first intermediate article W1) is deformed so as to flow into the first tooth-part forming part 22*a*. When the first tooth-part forming part 22*a* of the first center die 22 receives the blank (first intermediate article W1) having flown thereinto, the first tooth-part forming part 22*a* forges the second intermediate article W2. Namely, the first tooth-part forming part 22*a* of the first center die 22 presses the tapered part 4 and the same-diameter part 5 of the first intermediate article W1 so as to accelerate the deformation of the blank. Then, the blank (first intermediate article W1) flows into the tooth-crest-surface forming part 32*b* of the floating die 32 as well. At the same time, the blank (first intermediate article W1) flows into the rear-surface-part forming part 35*a* and the projecting-part forming part 35*b* of the second center die 35.

After the above deformation (inflow) of the blank, there are formed: the body part 10 having the tooth part 9 of an accomplished shape (due to the cold forging, the tooth part having a highly precise accomplished shape can be obtained) on the radially outer circumference, and the one-end recessed part 7 that is axially recessed in the axis-center part on the axially one-end side; and the projecting part 13 projecting from the rear surface part 15 of the body part 10 on the axially other-end side, whereby the second intermediate article W2 can be obtained.

Upon completion of the forming of the second intermediate article W2, the second knockout pin 36 remains at a position where the second knockout pin 36 is not in contact with the blank (projecting part 13) having flown into the projecting-part forming part 35*b* of the second center die 35. Namely, upon completion of the forming of the second intermediate article W2, there remains an unfilled space S2 between the projecting part 13 of the second intermediate article W2 and a wall surface of the die 31 defining the enclosed cavity space 50 (to be more specific, between the surface of the projecting part 13 on the other-end side and the surface of the second knockout pin 36 on the one-end side).

Thus, in the second forging step, the blank having flown into the projecting-part forming part 35*b* of the second center die 35 is prevented from being axially restricted (the blank can deform (flow) with a relatively low resistance). The positive promotion of the flow of the blank at the projecting part 13 results in a promotion of the flow of the whole blank. As a result, the tooth part 9 of an accomplished shape without any underfill can be obtained. This was confirmed by the actual test for mass production.

Upon completion of second intermediate article W2, inside the hermetically enclosed cavity space 50, a space S1 as shown in FIG. 4 may remain between the tooth crests 9*b* of the second intermediate article W2 and the tooth-crest-surface forming part 22*c* of the first center die 22. In this case, in the tooth part 9 of the second intermediate article W2, the outer circumferential parts 9*c* adjacent to the tooth crests 9*b* may not be formed with a high precision. However, this poses no problem in the performance of the bevel gear W3.

According to this embodiment, upon completion of the second intermediate article in the second forging step, there remains the unfilled space S2 between the projecting part 13 of the second intermediate article W2 and the wall surface of the die 31 defining the enclosed cavity space 50. Thus, the flowing blank is not restricted at the projecting part 13 throughout the second forging step (the blank can deform (flow) with a relatively low resistance), whereby the flowability of the blank can be improved. As a result, the tooth part 9 free of underfill can be formed with a high precision.

In addition, since the flowing blank has a part (the projecting part) that is not restricted throughout the second forging step, there is no possibility that a stress caused in the first die 21 and the second die 31 by the second forging step might become excessively large. Thus, the life time of the first die 21 and the life time of the second die 31 can be maintained for a longer period of time.

In addition, the first intermediate article W1 has the preliminary one-end recessed part 2 that is axially recessed in the axis-center part on the axially one-end side, and the preliminary other-end recessed part 6 that is axially recessed in the axis-center part on the axially other-end side. Thus, as compared with a case in which the preliminary one-end recessed part 2 and/or the preliminary other-end recessed part 6 are not formed, an amount of the blank from the bottom surface of the one-end recessed part 7 to the projecting part 13 of the second intermediate article W2 (an amount of the blank that is removed in the through-hole forming step) can be smaller. This means that a utilization efficiency of the blank is improved (high yield).

In addition, in this embodiment, when the forming of the second intermediate article W2 in the second forging step is completed, the overall outer surface of the second intermediate article W2 excluding the outer circumferential parts 9*c* of the tooth part 9 and the projecting part 13 is brought into contact with the wall surfaces defining the enclosed cavity space 50. Thus, there remains no burr part which should be removed, whereby the bevel gear W3 having the accomplished tooth part 9 can be formed with the lesser number of steps.

In addition, in this embodiment, the first intermediate article W1 has the tapered part 4 whose diameter is increased from the axially one-end side toward the axially other-end side, at an axial position corresponding to the tooth part 9 of the second intermediate article W2. Thus, in the second forging step, there can be effectively restrained that a flow amount of the blank to be formed into the tooth part 9 is too much and that undesired wrinkles (grooves) are formed in the upper end surface of the formed tooth part 9.

In addition, in this embodiment, the outside diameter of the projecting part 13 of the second intermediate article W2 is smaller than the inside diameter of the one-end recessed part 7 of the second intermediate article W2. Thus, an amount of the blank to be removed is smaller, and therefore an excellent utilization efficiency of the blank can be provided.

In the above embodiment, the first intermediate article W1 has both the preliminary one-end recessed part 2 and the preliminary other-end recessed part 6. However, at least when this patent application was filed, it is sufficient that the first intermediate article W1 has either the preliminary one-end recessed part 2 or the preliminary other-end recessed part 6.

In addition, in the above embodiment, as the through-hole forming step, the axis-center part 16 extending from the bottom surface of the one-end recessed part 7 to the projecting part 13 of the second intermediate article W2 is pierced. However, the axis-center part 16 may be removed by cutting.

In addition, in the above embodiment, the movement of the first knockout pin 27 and the movement of the floating die 32 are performed by using the respective elastic members. However, the movements thereof may be controlled by using a known hydraulic mechanism.

Figure 5:
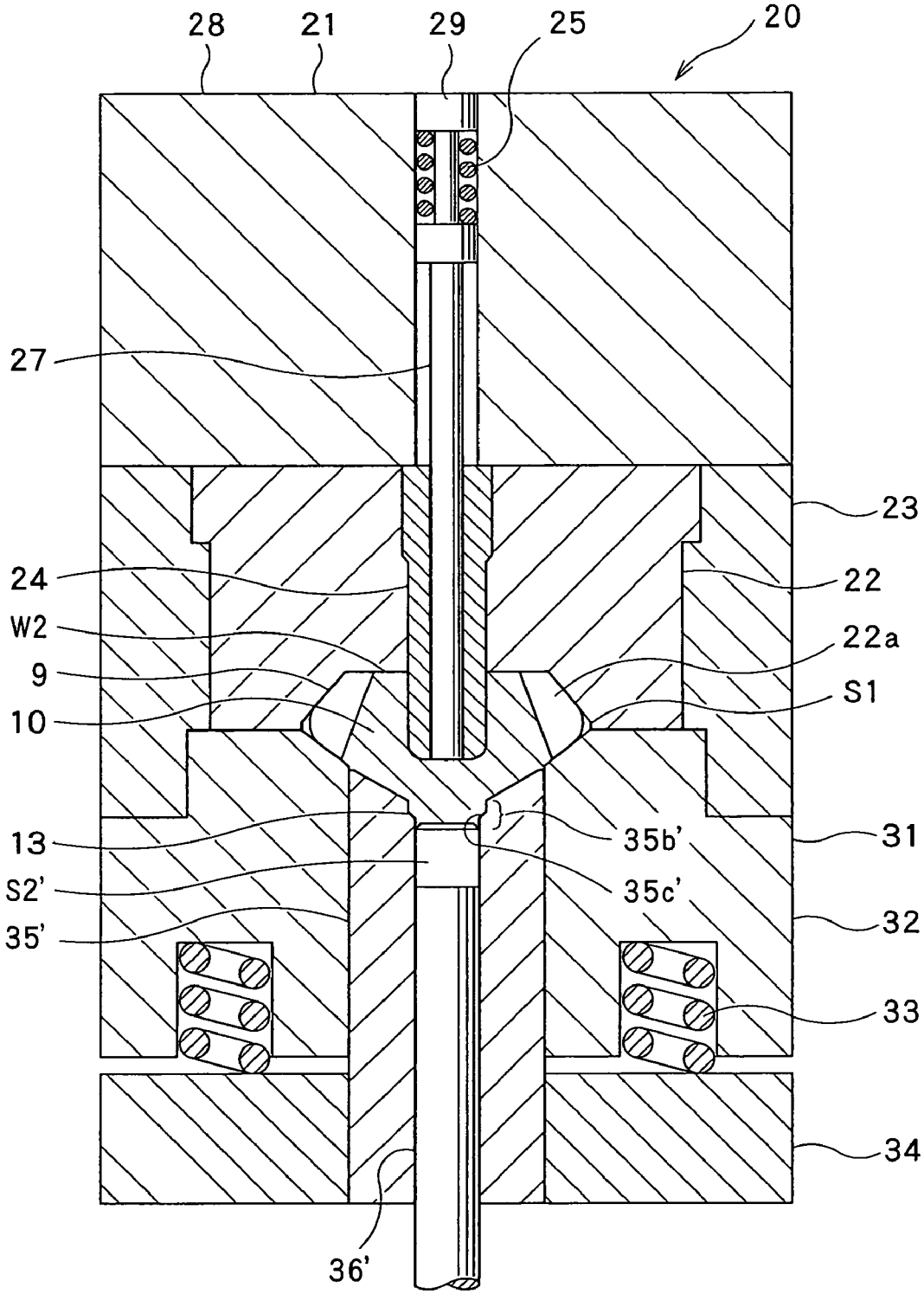
FIG. 5 is a partially sectional view showing a first die, a second die, and a second intermediate article, in a state after a second forging step of a second embodiment of a method of forging a bevel gear according to the present invention has been performed.
Figure 6A:
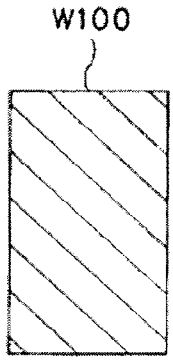
FIG.6A Related Art
FIGS. 6A to 6D, which are shown for explaining respective steps of a conventional method of forging a bevel gear, are sectional views showing a blank (bevel gear) in the respective steps.
Figure 6B:
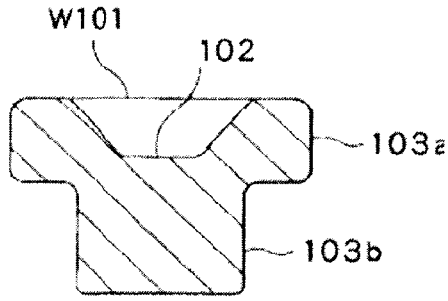
FIG.6B Related Art
Figure 6C:
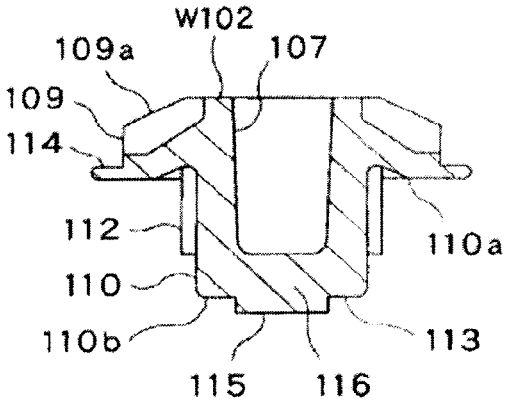
FIG.6C Related Art
Figure 6D:
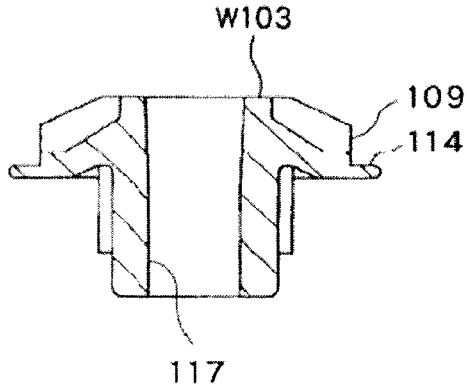
FIG.6D Related Art
Figure 7A:
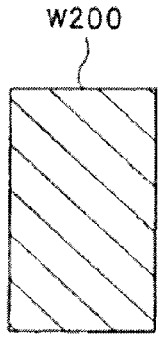
FIG.7A Related Art
FIGS. 7A to 7D, which are shown for explaining respective steps of another conventional method of forging a bevel gear, are sectional views showing a blank (bevel gear) in the respective steps.
Figure 7B:
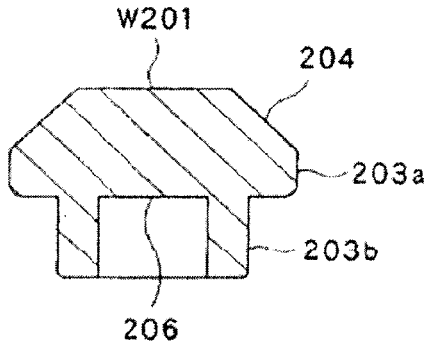
FIG.7B Related Art
Figure 7C:
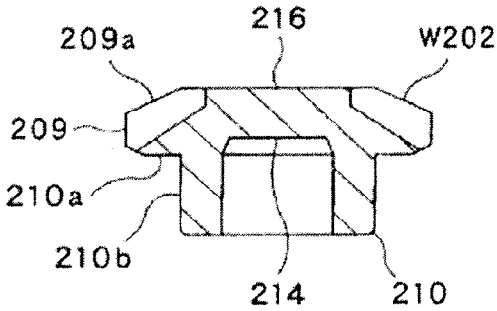
FIG.7C Related Art
Figure 7D:
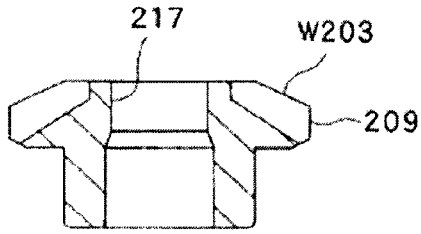
FIG.7D Related Art
Figure 8A:
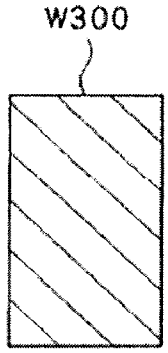
FIG.8A Related Art
FIGS. 8A to 8E, which are shown for explaining respective steps of a further conventional method of forging a bevel gear, are sectional views showing a blank (bevel gear) in the respective steps.
Figure 8B:
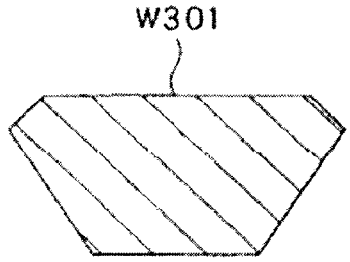
FIG.8B Related Art
Figure 8C:
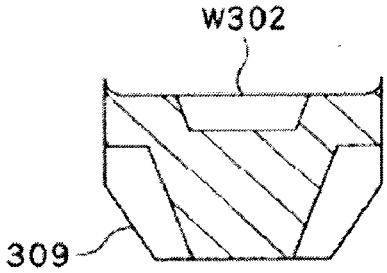
FIG.8C Related Art
Figure 8D:
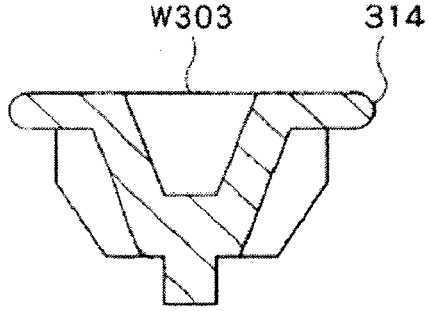
FIG.8D Related Art
Figure 8E:
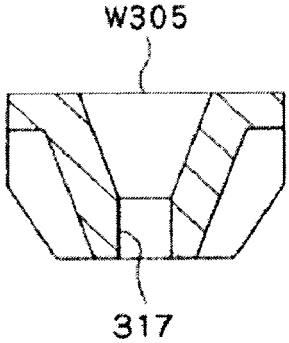
FIG.8E Related Art
Figure 9A:
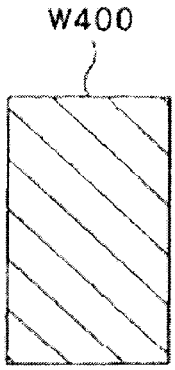
FIG.9A Related Art
FIGS. 9A to 9D, which are shown for explaining respective steps of a further conventional method of forging a bevel gear, are sectional views showing a blank (bevel gear) in the respective steps.
Figure 9B:
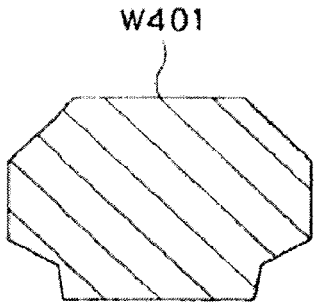
FIG.9B Related Art
Figure 9C:
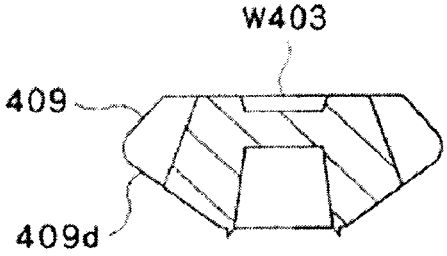
FIG.9C Related Art
Figure 9D:
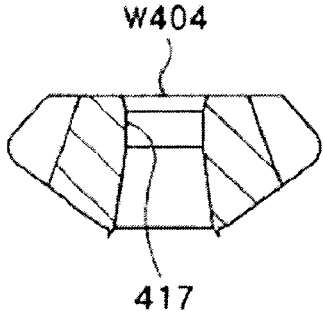
FIG.9D Related Art

Next, a second embodiment of the method of forging a bevel gear according to the present invention is described based on FIG. 5. FIG. 5 is a partially sectional view showing a first die, a second die, and a second intermediate article, in a state after a second forging step of a second embodiment of a method of forging a bevel gear according to the present invention has been performed.

Also in this embodiment, as shown in FIG. 5, a second center die 35' has a rear-surface-part forming part 35*a* on an axially one-end side thereof, a diameter of the rear-surface-part forming part 35*a* being decreased from the axially one-end side toward an axially other-end side. On the other-end side of the rear-surface-part forming part 35*a*, the second center die 35' has a projecting-part forming part 35*b'* being continuous from the rear-surface-part forming part 35*a*, and having a diameter smaller than that of the rear-surface-part forming part 35*a*. However, differently from the first embodiment, the projecting-part forming part 35*b'* has a tapered part 35*c'* whose diameter is decreased toward the axially other-end side. In accordance therewith, the diameter of a second knockout pin 36' is smaller than that of the first embodiment, and the inside diameter of the second center die 35' and the diameter of a space S2 are accordingly smaller.

The other structures in this embodiment are the same as those in the first embodiment. In FIG. 5, the same parts as those of the first embodiment are indicated by the same reference numbers as those in the first embodiment. Detailed description thereof is omitted.

In this embodiment, in a second forging step, a part (the tapered part 35*c'*) of the enclosed cavity space 50 gives a larger resistance to the projecting part 13, as a projecting amount (length) of the projecting part 13 is increased (a distance from the rear surface part 15 of the body part 10 on the axially other-end side to a distal end of the projecting part 13 is increased). More specifically, when the projecting part 13 flows into the tapered part 35*c'*, a resistance given by the enclosed cavity space 50 to the projecting part 13 is increased. By positively utilizing this principle, a flow amount of the whole blank can be desirably controlled. That is, when the resistance given by the enclosed cavity space 50 to the projecting part 13 is increased, the flow amount of the whole blank is decreased and the formation of the tooth part 9 is promoted in accordance therewith. Thus, by using this phenomenon, a highly precise tooth part 9 without any underfill or wrinkle can be formed with a higher yield. This was confirmed by the actual test for mass production.

In the region corresponding to the projecting part 13 of the enclosed cavity space 50, the part that is gradually narrowed in accordance with the distance from the rear surface part 15 on the axially other-end side is not limited to the tapered part 35*c*' which is formed in the tapered manner. For example, the diameter of the part may be reduced in a helical manner or a stepwise manner.

The invention claimed is:

1. A method of forging a bevel gear, comprising:

a first forging step in which a first intermediate article is obtained by pressing a blank, such that there is formed a preliminary one-end recessed part that is axially recessed in an axis-center part on an axially one-end side and/or a preliminary other-end recessed part that is axially recessed in an axis-center part on an axially other-end side;

a second forging step in which a second intermediate article is obtained by pressing the first intermediate article in a hermetically sealed cavity space defined by a first die and a second die that is positioned opposedly to the first die in the axial direction, such that there are formed: a body part including a tooth part on a radially circumference thereof and a one-end recessed part that is axially recessed in an axis-center part on the axially one-end side; and a projecting part projecting from a rear surface part of the body part on the axially other-end side in a columnar shape whose cross-section is smaller than that of the body part; and a through-hole forming step in which a bevel gear having a through hole in an axis-center part is formed by removing the axis-center part extending from a bottom surface of the one-end recessed part to the projecting part of the second intermediate article;

wherein:

the tooth part provides a tooth-crest surface which is tapered from the axially other-end side to the axially one-end side;

when the second forging step is started, the first intermediate article is placed in the hermetically sealed cavity space such that there is a space under the axis-center part on the axially other-end side of the first intermediate article;

in the second forging step, the axis-center part on the axially one-end side of the first intermediate article is axially pressed; and upon completion of the second intermediate article in the second forging step, there remains an unfilled space between the projecting part of the second intermediate article and a wall surface of the dies defining the cavity space.

2. The method of forging a bevel gear according to claim 1, wherein upon completion of the second intermediate article in the second forging step, the overall outer surface of the second intermediate article, excluding a radially outermost circumferential part of the tooth-crest surface of the tooth part and the projecting part, is brought into contact with the wall surfaces of the dies defining the cavity space.

3. The method of forging a bevel gear according to claim 1, wherein the first intermediate article has a tapered part whose diameter is increased from the axially one-end side toward the axially other-end side, at an axial position corresponding to the tooth part of the second intermediate article.

4. The method of forging a bevel gear according to claim 1, wherein the projecting part of the second intermediate article has an outside diameter smaller than an inside diameter of the one-end recessed part of the second intermediate article.

5. The method of forging a bevel gear according to claim 1, wherein when the second forging step is started, the first intermediate article is placed in the hermetically sealed cavity space such that there is a space under the preliminary other-end recessed part in the hermetically sealed cavity space and the space is extended downward lower than the lowest part of the first intermediate article.

6. A method of forging a bevel gear, comprising:

a first forging step in which a first intermediate article is obtained by pressing a blank, such that there is formed a preliminary one-end recessed part that is axially recessed in an axis-center part on an axially one-end side and/or a preliminary other-end recessed part that is axially recessed in an axis-center part on an axially other-end side;

a second forging step in which a second intermediate article is obtained by pressing the first intermediate article in a hermetically sealed cavity space defined by a first die and a second die that is positioned opposedly to the first die in the axial direction, such that there are formed: a body part including a tooth part on a radially circumference thereof and a one-end recessed part that is axially recessed in an axis-center part on the axially one-end side; and a projecting part projecting from a rear surface part of the body part on the axially other-end side in a columnar shape whose cross-section is smaller than that of the body part; and a through-hole forming step in which a bevel gear having a through hole in an axis-center part is formed by removing the axis-center part extending from a bottom surface of the one-end recessed part to the projecting part of the second intermediate article;

wherein:

the tooth part provides a tooth-crest surface which is tapered from the axially other-end side to the axially one-end side;

when the second forging step is started, the first intermediate article is placed in the hermetically sealed cavity space such that there is a space under the axis-center part on the axially other-end side of the first intermediate article;

in the second forging step, the axis-center part on the axially one-end side of the first intermediate article is axially pressed; and in a region corresponding to the projecting part, the cavity space has a part that is gradually narrowed in accordance with a distance from the rear surface part of the body part on the axially other-end side.

7. The method of forging a bevel gear according to claim 6, wherein upon completion of the second intermediate article in the second forging step, there remains an unfilled space between the projecting part of the second intermediate article and a wall surface of the dies defining the cavity space.

8. The method of forging a bevel gear according to claim 6, wherein upon completion of the second intermediate article in the second forging step, the overall outer surface of the second intermediate article, excluding a radially outermost circumferential part of the tooth-crest surface of the tooth part and the projecting part, is brought into contact with the wall surfaces of the dies defining the cavity space.

9. The method of forging a bevel gear according to claim 6, wherein the first intermediate article has a tapered part whose diameter is increased from the axially one-end side toward the axially other-end side, at an axial position corresponding to the tooth part of the second intermediate article.

10. The method of forging a bevel gear according to claim 6, wherein the projecting part of the second intermediate article has an outside diameter smaller than an inside diameter of the one-end recessed part of the second intermediate article.

* * * * *